US005785240A

United States Patent [19]

Showler et al.

[11] Patent Number: 5,785,240

[45] Date of Patent: Jul. 28, 1998

[54] TOP CLOSURE ARRANGEMENT FOR A RECTANGULAR CONTAINER

[75] Inventors: Michael F. Showler, Waterford; Leslie Pape, Novi, both of Mich.

[73] Assignee: Elopak Systems AG, Glattbrugg, Switzerland

[21] Appl. No.: 699,576

[22] Filed: Aug. 19, 1996

[51] Int. Cl.[6] ..... B65D 5/08

[52] U.S. Cl. ..... 229/137; 229/125.15; 229/125.42

[58] Field of Search ..... 229/125.15, 137, 229/138, 213, 125.42, 117.12

[56] References Cited

U.S. PATENT DOCUMENTS

| | | | |
|---|---|---|---|
| 1,994,923 | 3/1935 | Ross | 229/137 |
| 4,327,861 | 5/1982 | Thompson | 229/137 X |
| 4,390,121 | 6/1983 | Lisiecki . | |
| 4,702,410 | 10/1987 | Derving | 229/138 X |
| 4,785,993 | 11/1988 | Lisiecki | 229/137 |
| 4,911,306 | 3/1990 | Lisiecki et al. | 206/631.2 |
| 4,971,243 | 11/1990 | Lisiecki | 229/125.15 |
| 5,029,713 | 7/1991 | Lisiecki | 206/626 |
| 5,086,928 | 2/1992 | Lisiecki | 229/217 |
| 5,474,232 | 12/1995 | Ljungstrom et al. | 229/137 |
| 5,636,785 | 6/1997 | Kalberer et al. | 229/125.15 X |

FOREIGN PATENT DOCUMENTS

| | | | |
|---|---|---|---|
| 491759B1 | 6/1995 | European Pat. Off. | B65D 5/74 |
| 2253611 | 3/1992 | United Kingdom | B65D 5/06 |

*Primary Examiner*—Gary E. Elkins

*Attorney, Agent, or Firm*—Reising, Ethington, Barnard & Perry

[57] ABSTRACT

A top closure arrangement for an oblong rectangular, gable top container, wherein selected score lines are formed on the wider top closure panels defining panel segments for inward folding during the sealing process. A pour spout fitment is thus mounted on one of the narrow, outer flat closure panels for more convenient handling of the container by the consumer during the pouring process.

8 Claims, 2 Drawing Sheets

TOP CLOSURE ARRANGEMENT FOR A RECTANGULAR CONTAINER

FIELD OF THE INVENTION

This invention relates generally to fluid-carrying containers and, more particularly, to an improved top closure arrangement for an oblong rectangular cross-section, gable-top type container.

BACKGROUND ART

For gable-top paperboard containers having an oblong rectangular cross-section, the conventional sealing fins extend across the center of the top of the oppositely disposed wider body panels. When a capped pouring spout fitment is to be mounted on one of the wider top closure panels, manually gripping across the wider body panels for pouring the contents of the container is not convenient or easy for most consumers. Accordingly, it would be advantageous for gripping the container to have sealing fins extending across the center of the top of the oppositely disposed narrower body panels..with the pouring spout fitment mounted on one of the narrower closure panels. As such, the convenience of handling would be comparable to the handling of a gable top rectangular container with an integral pouring spout, such as shown in Lisiecki U.S. Pat. No. 4,390,121; in the flat top rectangular containers shown in Lisiecki et al U.S. Pat. No. 4,911,306, and in Lisiecki U.S. Pat Nos. 4,785,993; 5,029,713; and 5,086,928; and also in the slant top rectangular containers shown in European Patent Publication no. 0,491,759,B1, and in UK Patent Application Publication no. 2,253,611A, and in Lisiecki U.S. Pat. No. 4,971,243.

DISCLOSURE OF THE INVENTION

A general object of the invention is to provide an improved top closure arrangement for a gable top type, rectangular cross-section container having pouring means, e.g. a pour spout fitment, provided on a top panel thereof.

Another object of the invention is to provide such a top closure arrangement for a rectangular, gable top container, wherein the external sealing fins are formed across the center of the top of oppositely disposed narrower body panels.

A further object of the invention is to provide such a top closure arrangement for a rectangular, gable top container, wherein selected score lines are formed on the wider top closure panels defining panel segments for inward folding during the sealing process, with pouring means, e.g. a pour spout fitment, provided on one of the narrower, outer planar closure panels for more convenient handling of the container by the consumer during the pouring process.

These and other objects and advantages will become more apparent when reference is made to the following drawings and the accompanying description.

BEST MODE FOR CARRYING OUT THE INVENTION

Figure 1:
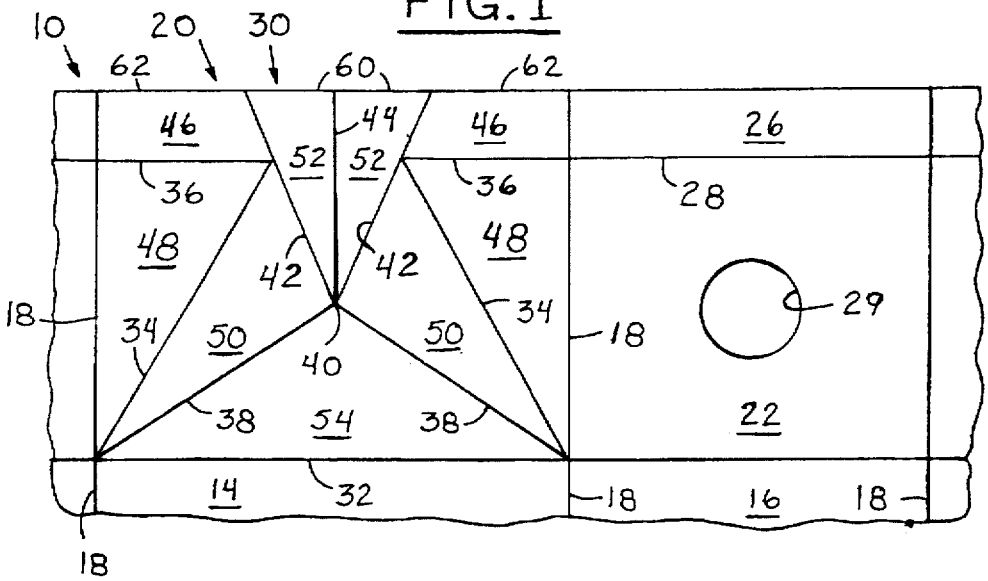
FIG. 1 is a fragmentary plan view of a blank for forming a container top closure.
Figure 2:
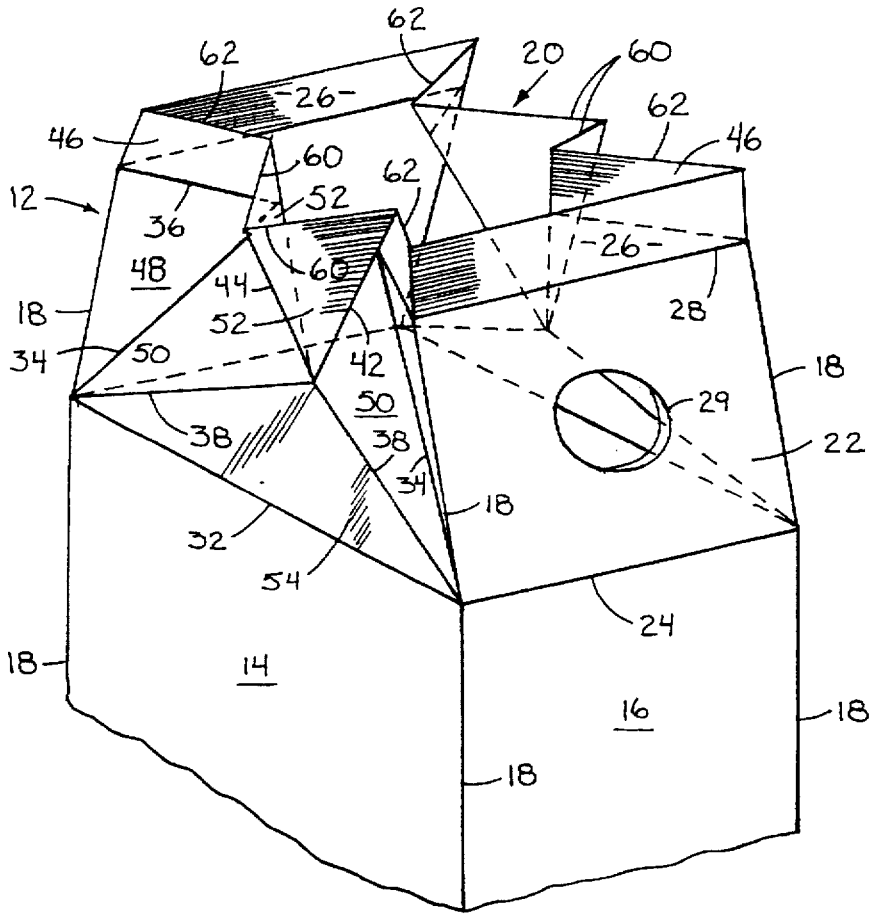
FIG. 2 is a fragmentary perspective view of a tubular container top closure formed from the blank of FIG. 1, and shown in a partially closed condition.
Figure 3:
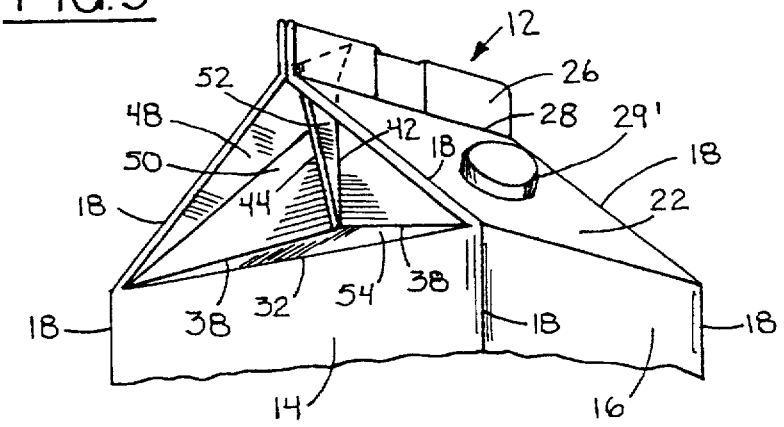
FIG. 3 is a fragmentary perspective view of the completely closed container top closure of FIG. 2.

Referring now to the drawings in greater detail, FIG. 1 illustrates a thermoplastic coated blank 10 for forming the rectangularly-shaped container 12 illustrated in FIGS. 2 and 3.

The blank 10 includes two wider body panels 14 and two narrower body panels 16, separated by vertical score lines 18. The top closure arrangement 20 includes a rectangular panel 22 separated by a horizontal score line 24 from each narrower body panel 16. A sealing fin 26 is separated by a horizontal score line 28 from each panel 22. A pouring spout fitment, mounted in a hole 29 in the panel 22 and represented as 29', is mounted on one of the narrower panels 22 in any convenient manner, such as shown and described in Pape et al U.S. Pat. No. 5,267,934, or in Owen et al U.S. Pat. No. 5,435,803.

A foldable, rectangular panel 30 is separated by a horizontal score line 32 from each wider body panel 14. The panel 30 includes symmetrical upwardly converging diagonal score lines 34 extending from each intersection of the score lines 32 and 18 to horizontal score lines 36 extending from the respective adjacent score lines 28.

Additional symmetrical upwardly converging diagonal score lines 38 extend from each intersection of the score lines 32 and 18 to intersect at a point 40 midway across the panel 30.

Symmetrical upwardly diverging diagonal score lines 42 extend from the intersection point 40 to the free edge of the panel 30, passing through the intersecting ends of the score lines 34 and 36.

A center vertical score line 44 extends upwardly from the intersection point 40 to the free edge of the panel 30.

Sealing fins 46 are enclosed by the score lines 18, 36, 42 and the free edge of the panel 30. The score lines 18, 34 and 36 define panel segments 48. The score lines 34, 38 and 42 define panel segments 50. The score lines 42, 44 and the free edge of the panel 30 define panel segments 52. The score line 32 and the two score lines 38 define panel segment 54.

While the blank 10 is being folded to form the container 12, each panel 30 folds along its various score lines as follows. Each of the panel segments 48, 50 and 54 protrudes inwardly, and the dual panel segments 52 protrude outwardly within the confines of the panel segments 46, 48, 50 and 54.

The sealing fins 46 extend toward one another to confine the upper portions of the panel segments 52 there-between. The sealing fins 26 above the panels 22 progressively approach each other (FIG. 2) until they confine the sealing fins 46 and upper portions of the panel segments 52 between their outer edge portions, and directly engage each other at their center portions (FIG. 3).

The bottom closure (not shown) is a conventional closure arrangement, such as shown and described in Braun U.S. Pat. No. 3,498,524, incorporated herein by reference.

Inasmuch as the free edges 60 of the panel 30 between the ends of the sealing fins 46 are aligned with the free edges 62 of the latter on the blank 10 (FIG. 1), the free edges 60 dip downwardly, as may be noted in FIG. 2, during the folding process. Due to the free edges 60 dipping downwardly, the adjacent upper portions of the panel segments 52 that are sealed as described above are triangularly shaped between the sealing fins 46.

Figure 4:
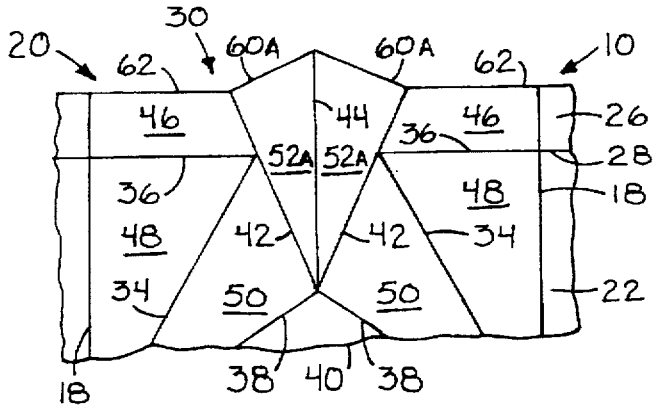
FIG. 4 is a fragmentary plan view of a modification of the FIG. 1 structure.
Figure 5:
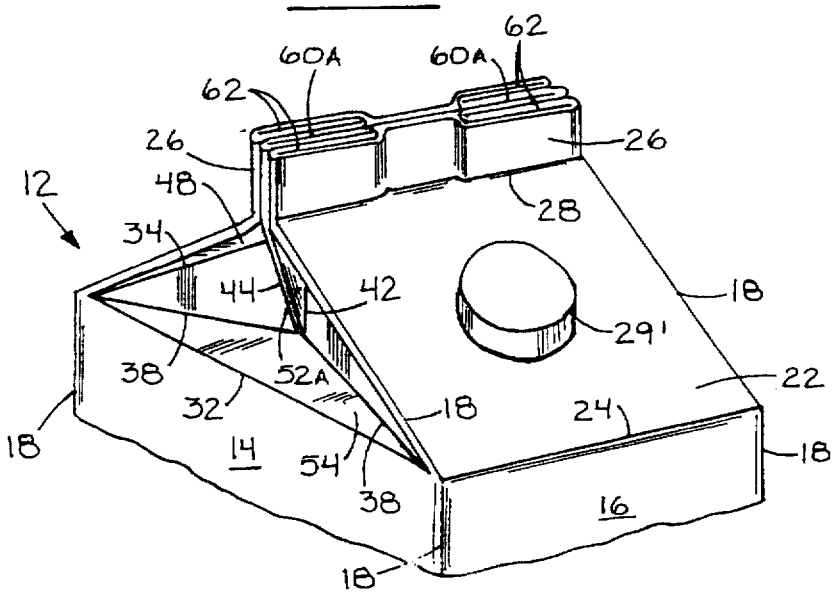
FIG. 5 is a fragmentary perspective view of the completely closed container top closure of FIG. 4.

If it should be desirable that the free edges 60 and 62 be aligned after folding, for a more uniform sealing configuration, as shown in FIG. 5, the blank 10 of FIG. 4 is formed to include upwardly converging free edges 60*a*, thereby extending the panel segments 52*a*.

INDUSTRIAL APPLICABILITY

It is apparent that the invention provides an oblong rectangular gable top type container (which may be of the slant top type) which includes a top seal which extends laterally across the width of the oppositely disposed narrower body panels, rather than the conventional top seal which is parallel to the wider body panels. As such, the carton is more readily and easily handled by the consumer while pouring the contents of the carton, than if the top seal extended across the length of the wider panels, with the pouring means located on one of the wider panels.

It should be further apparent that the invention may be practiced on one wider end of a container top closure with a conventional folded and sealed gable top arrangement, such as shown and described in Crawford et al U.S. Pat. No. 3,116,002 (incorporated herein by reference), included on the other wider end of the container to provide the well-known integral and openable pour spout therein.

While but one general embodiment of the invention has been shown and described, other modifications are possible within the scope of the following claims. For example, the pouring means may take the form of the pour spout fitment 29' or a hatch fitment closing the pouring hole 29 formed through the narrower closure panel or covering a narrower closure panel zone through which a consumer will form a pouring hole. Alternatively, the pouring means may take the form of a tear zone which can be torn by a consumer to reveal or form a pouring hole through a narrower closure panel.

What is claimed is:

1. On a gable top container having two oppositely disposed wider body and adjacent top panels and two oppositely disposed narrower body and adjacent top panels, a top closure arrangement comprising sealing fins formed on the wider and narrower top panels with the sealing fins on the wider top panels sealed between the sealing fins on the narrower top panels, wherein the sealing fins on each of said narrower top panels extend full width of the narrower top panels, and the sealing fins on each of said wider top panels are spaced apart and positioned at the respective sides thereof.

2. The top closure arrangement described in claim 1, and further comprising score lines formed on each of said wider top panels to define panel segments folded within said narrower top panels.

3. The top closure arrangement described in claim 1, and pouring means provided on one of said narrower top panels.

4. The top closure arrangement described in claim 3, wherein said pouring means comprises a pouring spout fitment.

5. The top closure arrangement described in claim 1, wherein said panel segments of each wider top panel include a central in-folded triangular panel segment, two adjacent in-folded triangular panel segments on each side of the central in-folded triangular panel segment, and two adjacent out-folded triangular panel segments intermediate two in-folded triangular panel segments on the sides of the central in-folded triangular panel segment.

6. The top closure arrangement described in claim 5, wherein, for each wider top panel, said two adjacent out-folded triangular panel segments have their apices positioned at the apex of said central in-folded triangular panel segment, and the sides opposite the apices positioned between the sealing fins on the wider top panel.

7. The top closure arrangement described in claim 5, wherein, for each wider top panel, each two adjacent in-folded triangular panel segments have apices which meet at a corner between the adjacent body and top panels, and sides opposite the apices which abut against a side of one of the sealing fins and one of the out-folded triangular panel segments, respectively.

8. The top closure arrangement described in claim 6, wherein, for each wider top panel, said sides opposite the apices of the out-folded triangular panel segments are sealed between said sealing fins on said wider top panel.

* * * * *